US011274890B2

(12) United States Patent
Gregorich et al.

(10) Patent No.: US 11,274,890 B2
(45) Date of Patent: Mar. 15, 2022

(54) ADVANCED GAS PISTON SYSTEM

(71) Applicants: Michael Gregorich, Santa Paula, CA (US); Ramon Melendez, Las Vegas, NV (US)

(72) Inventors: Michael Gregorich, Santa Paula, CA (US); Ramon Melendez, Las Vegas, NV (US)

( * ) Notice: Subject to any disclaimer, the term of this patent is extended or adjusted under 35 U.S.C. 154(b) by 0 days.

(21) Appl. No.: 16/902,599

(22) Filed: Jun. 16, 2020

(65) Prior Publication Data

US 2021/0033362 A1 Feb. 4, 2021

Related U.S. Application Data

(62) Division of application No. 16/009,700, filed on Jun. 15, 2018, now Pat. No. 10,852,084.

(51) Int. Cl.

| | |
|---|---|
| ***F41A 5/26*** | (2006.01) |
| ***F41A 3/66*** | (2006.01) |
| ***F41A 5/18*** | (2006.01) |
| ***F41A 15/14*** | (2006.01) |

(52) U.S. Cl.
CPC *F41A 5/26* (2013.01); *F41A 3/66* (2013.01); *F41A 5/18* (2013.01); *F41A 15/14* (2013.01)

(58) Field of Classification Search
CPC ..... F41A 5/18; F41A 5/26; F41A 3/66
See application file for complete search history.

(56) References Cited

U.S. PATENT DOCUMENTS

| | | | | |
|---|---|---|---|---|
| 2,069,432 A * | 2/1937 | Watanabe | F41A 5/18 | 89/189 |
| 3,951,038 A * | 4/1976 | Van Langenhoven | B25C 1/12 | 89/7 |
| 6,619,592 B2 * | 9/2003 | Vignaroli | F41A 5/18 | 89/191.01 |
| 8,297,167 B2 * | 10/2012 | Hoffman | F41A 9/20 | 89/11 |
| 8,418,389 B1 * | 4/2013 | Lukman | F41A 5/34 | 42/1.06 |

(Continued)

FOREIGN PATENT DOCUMENTS

DE 860019 C * 12/1952 ..... F41A 3/66

*Primary Examiner* — Joshua T Semick
(74) *Attorney, Agent, or Firm* — The Thornton Firm, LLC

(57) ABSTRACT

An advanced gas piston operating system for Armalite Rifle (AR) and Armalite Rifle variants. The advanced gas piston system may include a barrel having a gas port formed through the barrel wall, a gas block assembly, a gas piston assembly, and upper receiver assembly, a sending block, rack and gear assembly, and a bolt carrier assembly with an attached rack. In such a system, a portion of the combustion gases from a fired projectile travel through a gas port in the barrel into a gas block assembly which drives a piston forward which compresses a main spring on an attached rod. The opposite end of the rod is attached to a sending block rack and gear assembly with the gear rotatably engaged with the teeth of another rack that is attached to the bolt carrier assembly. As the gas piston assembly moves forward, the bolt carrier assembly moves rearward until the main spring is fully compressed. Decompression of the main spring returns bolt carrier assembly forward loading the next round into the chamber.

10 Claims, 19 Drawing Sheets

(56) References Cited

U.S. PATENT DOCUMENTS

| | | | | |
|---|---|---|---|---|
| 10,436,531 | B2 * | 10/2019 | Lytinas | F41A 19/30 |
| 2015/0377583 | A1 * | 12/2015 | Furusho | F41A 3/56 42/1.06 |

* cited by examiner

ADVANCED GAS PISTON SYSTEM

CROSS- REFERENCE TO RELATED APPLICATIONS

The present divisional patent application claims priority benefit of the U.S. provisional application for patent Ser. No. 62/520,895 titled "Advanced Gas Piston System" filed on Jun. 16, 2017 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

The present application is a divisional application from U.S. application for patent Ser. No. 16/009,700 titled "Advanced Gas Piston System" filed on Jun. 15, 2018 which is currently co-pending with this present application.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

BACKGROUND OF THE INVENTION

1. Field of Invention

The invention relates generally to the field of firearms. More specifically, the present invention relates to an advanced operating system of the Armalite Rifle (AR) and Armalite Rifle variants.

2. Description of the Related Art

The Armalite Rifle (AR) system is a gas-operated autoloading system which has been in existence since the mid to late 1950s. Employing a gas operated bolt and carrier system as invented by Eugene Stoner in U.S. Pat. No. 2,951,424, the direct impingement mechanism was designed to be light and inexpensive to manufacture because of its simplicity. Over its evolving lifetime, it has become one of the most recognizable firearm operating systems in the world employed by militaries, police forces and civilians alike. As such, numerous variants have been developed such as the AR-10, the AR-15, the CAR-15, the M16, and the M4 Carbine.

In such direct impingement systems, when the rifle or firearm is fired, a portion of the expanding propellant gas is diverted through a hole in the barrel through a tube and into a key located in the bolt carrier assembly. The pressure of this gas drives the bolt carrier rearward which allows for the extraction and ejection of a spent round casing as well as the rotation and unlocking of the bolt. The bolt is then driven forward by a buffer and spring assembly where another round is fed and chambered. The preferred ammunition used by such variants is the .223 Remington, or the nearly identical 5.56×45 mm NATO. However, other calibers used include the .300 AAC Blackout, .300 Whisper, .308 NATO, 6.5 mm Grendel, 6.8 mm Remington SPC, 5.7×28 mm, 7.62×39 mm, .458 SOCOM, .50 Beowulf, and .50 BMG.

The direct impingement system, however, comes with disadvantages. It is well known in the art that the AR system is prone to fouling and jamming due to combustion byproducts coming in contact with the bolt carrier and receiver. Furthermore, the direct impingement system requires a buffer and buffer spring to move the bolt carrier group forward, which makes the use of a folding stock virtually impossible. Moreover, recoil and muzzle rise with the use of higher caliber ammunition such as .308 NATO require the user of such variants to employ heavier and larger-scaled components to accommodate the extra energy produced. Finally, multiple-round bursts or fully automatic fire prevent the user of such firearms from maintaining constant aim on a particular target.

As a result of the aforementioned limitations in the original direct impingement system, numerous retrofit gas piston systems have been developed for the Armalite Rifle and its variants. In contrast to direct impingement, a gas piston system uses propellant gases from a fired cartridge to actuate a piston, which pushes on a rod which drives the bolt carrier rearward which allows for the extraction and ejection of a spent round as well as the rotation and unlocking of the bolt. The gas piston system uses the existing gas port location and gas port diameter already in place on the original direct impingement AR platform. Such retrofit systems are able to work with existing gas port sizes and locations common to the AR system. The use of a gas piston system does not foul up the chamber/ bolt carrier group, as the gases are expelled at or near the gas block. This makes the gas piston system a cleaner system which prevents malfunctions caused by fouling from the gases. Such systems, however, do not eliminate the need for a buffer and spring assembly to drive and return the bolt forward after a round is fired.

Despite numerous advances and retrofit systems available, though, there still exists a need to reduce or eliminate recoil in the Armalite Rifle system. There also exists the need for a lighter operating system which is less prone to fouling from combustion by-products. Furthermore, there still exists a need for the elimination of muzzle rise in the Armalite Rifle system. Finally, there still exists a need for an operating system in the Armalite Rifle which eliminates the need for a buffer and buffer spring.

SUMMARY

The object of the present invention is to provide an advanced gas piston system, or reversed impingement operating system, for the Armalite Rifle (AR) and Armalite Rifle variants. Such a system will significantly reduce or eliminate recoil, mitigate or eliminate muzzle rise, and eliminate the need for a buffer and buffer spring assembly thus enabling the use of a collapsible or folding stock without affecting the operation of the firearm itself.

The reversed impingement technology of the advanced gas piston system operates through the use of a gas piston, sending block, and rack and pinion gear system. When a bullet is fired, the expanding combustion gas propels a bullet forward in the barrel. A port above the barrel aligns with a port in a gas block through which gas travels and moves a piston forward. The piston is attached to a rod, a main spring and a sending block which is offset and housed in the upper receiver above the bolt carrier group. The sending block has an attached rack which engages a gear. When the sending block moves forward, the gear rotates clockwise engaging the teeth of the rack connected to the bolt carrier group. As a result, the bolt carrier group moves rearward compressing the main spring while extracting the cartridge from the chamber of the barrel. When the main spring reaches its maximum compression, it then decompresses which moves the piston, piston rod and sending block with the attached rack rearward. The gear rotates counterclockwise engaging the teeth on the rack that is attached to the bolt carrier group moving it forward where the next round is then pushed from a magazine into the chamber. The cycle restarts when the trigger is pulled and the hammer strikes the firing pin.

The advanced gas piston system counteracts the force generated from the firing of a projectile by sending the gases forward and using a sending block to move in the opposite direction of the bolt-carrier group. This advanced gas piston system uses reversed impingement technology which eliminates or substantially reduces recoil, eliminates or substantially reduces muzzle rise by counteracting the generated forces of a fired projectile, and eliminates the need for a buffer and buffer spring assembly allowing for the use of a folding stock. Additionally, the advanced gas piston system provides a cleaner operating system, as hot gases and combustion by-products are directed away from all critical moving parts within the upper receiver. Finally, the advanced gas piston system may also reduce the overall weight of the firearm due to the modifications such as elimination of the buffer and buffer spring, the bolt handle cut out on the receiver and the modification of the bolt carrier group.

BRIEF DESCRIPTION OF THE DRAWINGS

The invention directed by way of example, and not by way of limitation, in the figures of the accompanying drawings and in which like reference numerals refer to similar elements and in which.

Figure 1A:
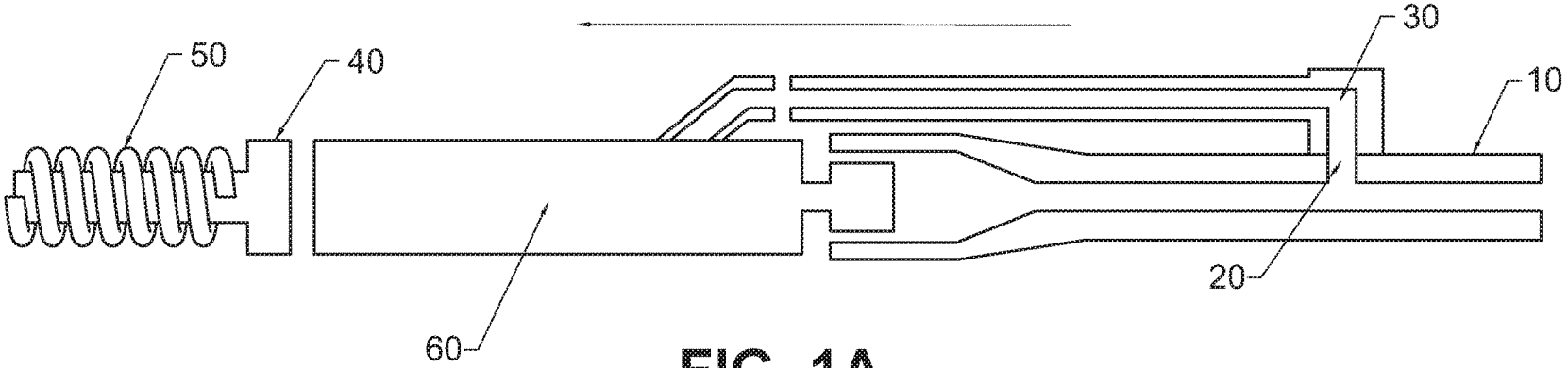
FIG. 1A (Prior Art)
FIG. 1A is a side sectional functional representation of the gas impingement system as known in the prior art.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

References to "one embodiment," "one variant," "an embodiment," "a variant," "various embodiments," "numerous variants," etc., may indicate that the embodiment(s) of the invention so described may include particular features, structures, or characteristics. However, not every embodiment or variant necessarily includes the particular features, structures, or characteristics. Further, repeated use of the phrase "in one embodiment," or "in an exemplary embodiment," or "a variant," or "another variant," do not necessarily refer to the same embodiment although they may. A description of an embodiment with several components in communication with each other does not imply that all such components are required. On the contrary, a variety of optional components are described to illustrate the wide variety of possible embodiments and/or variants of the present invention.

As is well known to those skilled in the art, many careful considerations and compromises typically must be made when designing for the optimal manufacture of a commercial implementation of such an advanced gas piston system. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

The exemplary advanced gas piston system will now be described in detail with reference to embodiments thereof as illustrated in the accompanying drawings.

FIG. 1A illustrates a functional side cross sectional view of a gas impingement system well known in the prior art. In such a system, a portion of the high-pressure propellant gases released when a round is fired are channeled through a small port 20 in the barrel 10 which proceeds through a gas block 30 which then travels rearward where the propellant gas can directly contact, or impinge, the rifle's bolt carrier group 60. The bolt carrier group pushes on a buffer 40 which compresses the buffer spring 50. The decompression of the buffer spring 50 moves the bolt carrier group 60 forward to begin the next cycle.

Figure 1B:
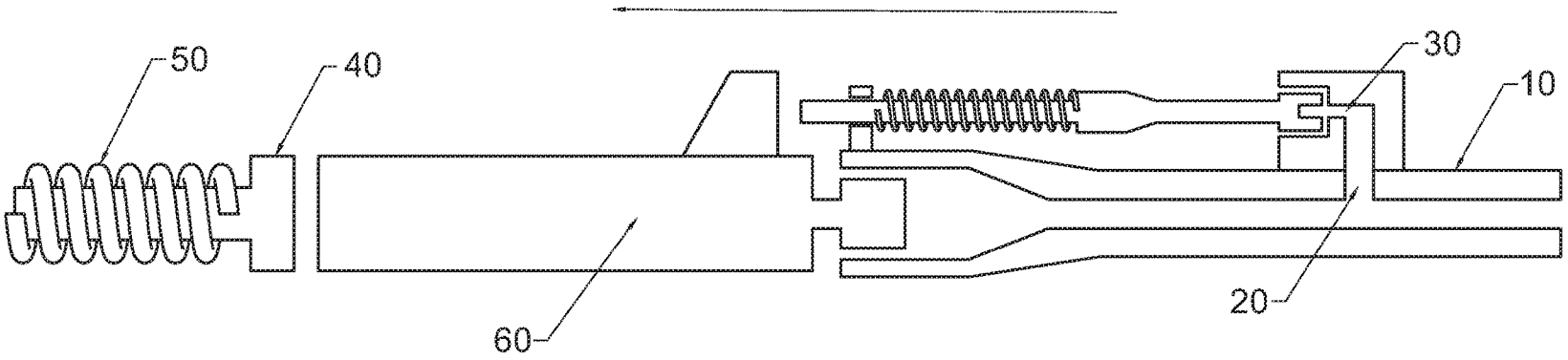
FIG. 1B (Prior Art)
FIG. 1B is a side sectional functional representation of the gas piston system as known in the prior art.

FIG. 1B illustrates a functional side cross sectional view of a gas piston system also well known in the prior art. As with the direct impingement system, a portion of the high pressure propellant gases released when a round is fired is channeled through a small hole 20 in the barrel 10. The gas travels through a gas block 30 designed with a piston which drives a rod rearward. The bolt carrier group 60 moves rearward by the force of the rod which pushes on a buffer 40 which compresses the buffer spring 50. The decompression of the buffer spring moves the bolt carrier group forward to begin the next cycle.

Figure 1C:
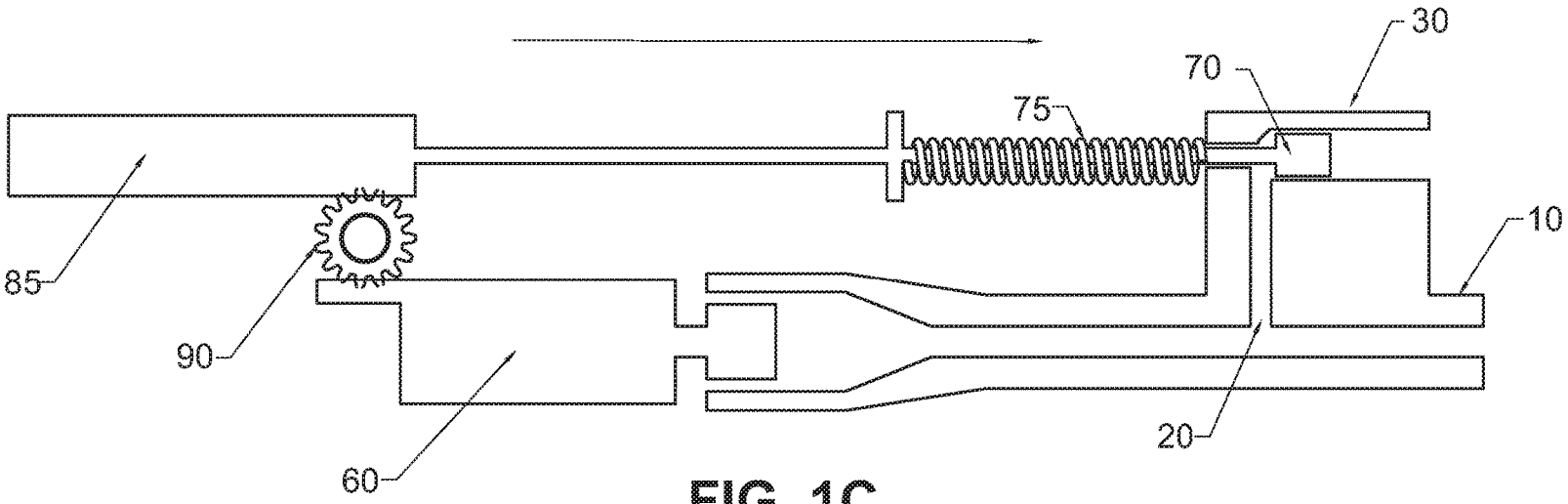
FIG. 1C is a side sectional functional representation of one variant of the advanced gas piston system in accordance with an embodiment of the invention.
Figure 1D:
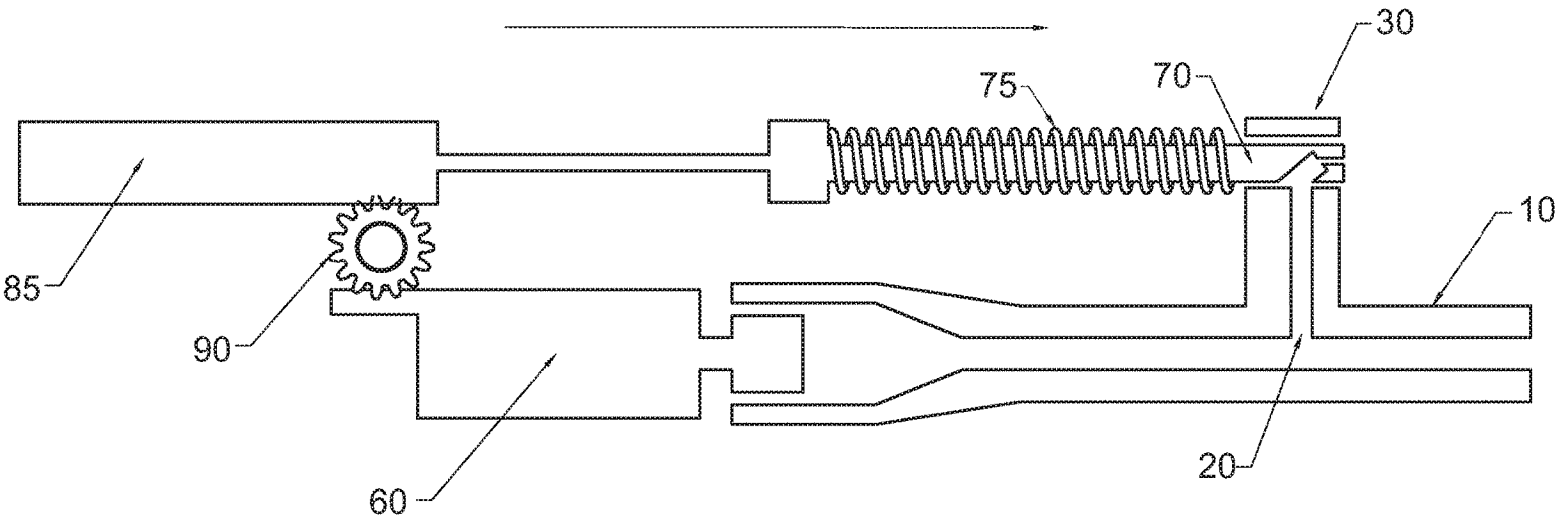
FIG. 1D is a side sectional functional representation of another variant of the advanced gas piston system in accordance with an embodiment of the invention.

FIG. 1C and FIG. 1D illustrate functional side cross sectional views of the advanced gas piston system in accordance with two embodiments of the present invention. In each advanced gas piston system, a portion of the combustion gases from a fired projectile are directed into a port 20 located in the barrel 10. The gas travels upward into a gas block 30 and drives, or impinges, a piston 70 forward, as opposed to rearward. This reversed impingement energy on the piston compresses a main spring 75 on an attached rod. The rod is attached to a sending block 85 housed within an upper receiver. The sending block 85 has an attached rack with teeth that engage a gear 90 which is rotatably engaged with the rack attached to the sending block 85 and a rack attached to the bolt carrier group 60. The gear 90 rotates clockwise which engages the teeth of a rack that is attached to the bolt carrier group 60. The bolt carrier group 60 moves rearward until the main spring 75 is fully compressed. The decompression of the main spring 75 returns the piston 70, piston rod 80, and sending block 85 to the rear. The engagement of the rack teeth rotates the gear counter clockwise which moves the bolt carrier assembly 60 forward to begin the next cycle.

Figure 2A:
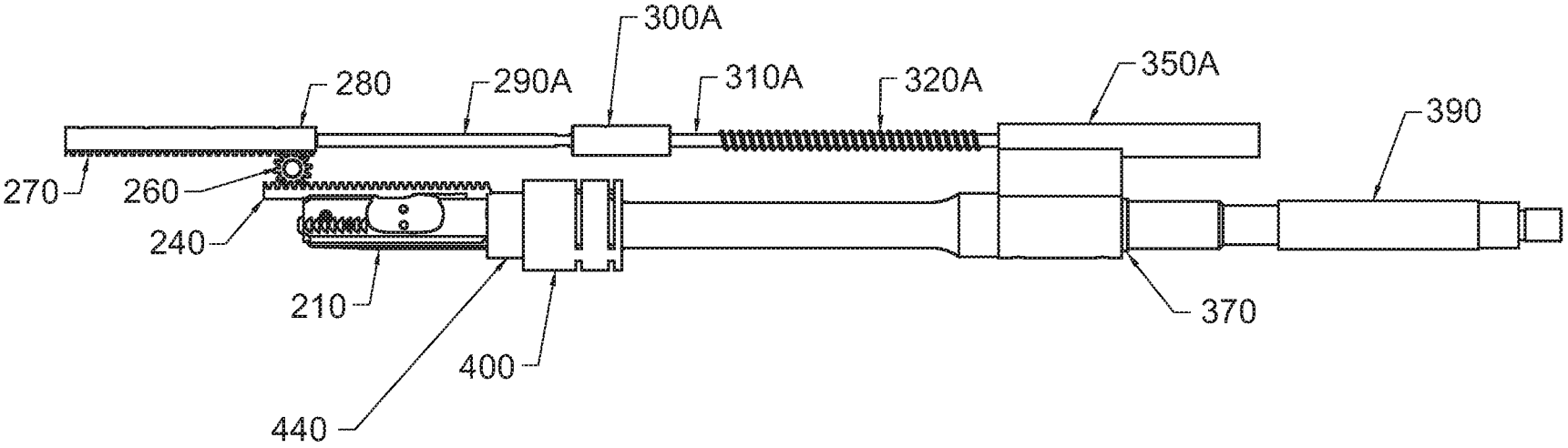
FIG. 2A is side view of the barrel, gas piston and bolt carrier assemblies of the advanced gas piston system in accordance with an embodiment of the invention.

FIG. 2A illustrates a side view of one embodiment of the barrel, gas piston and bolt carrier assemblies of the advanced gas piston system. In this embodiment, a chamber extending from the gas block 350A houses the piston 360A. The chamber is located behind the gas block 350A (yet forward down the rifle barrel), and is configured to create greater pressure to move the piston 360A and its attached components forward when the rifle is fired. The sending block 280 can have a sending block rod 290A attached to the forward area of the sending block and sending block rack which extends towards the muzzle end of the firearm. The sending block rod is either a rod or squared piece of material that is either pinned, machined or threaded into the sending block or sending block rack. The sending block rod 290A is connected to the piston rod 310A by a rod connector 300A.

Figure 2B:
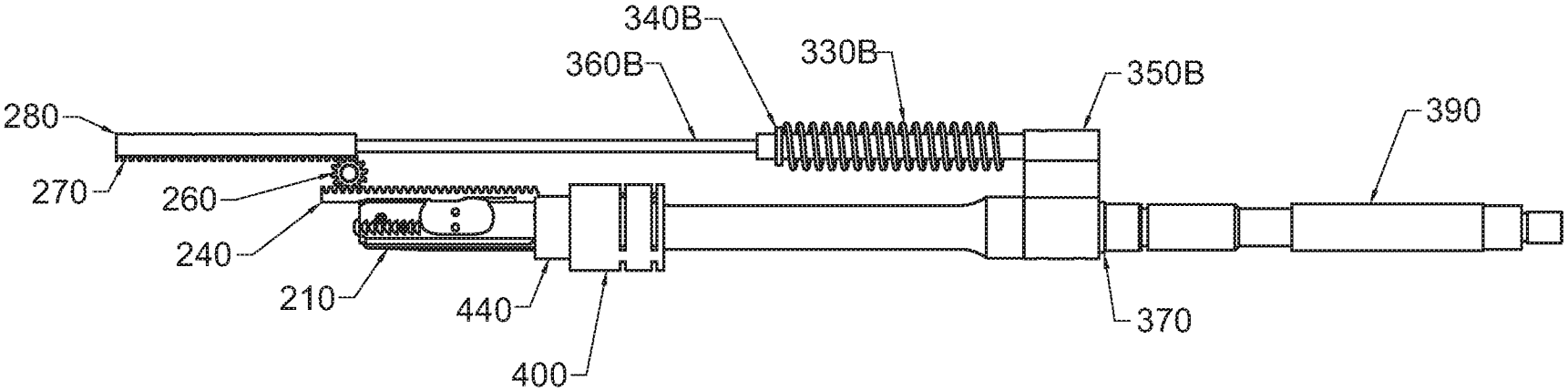
FIG. 2B is a side view of the barrel, gas piston and bolt carrier assemblies of the advanced gas piston system in accordance with an embodiment of the invention.

FIG. 2B illustrates a side view of another embodiment of the barrel, gas piston and bolt carrier group assemblies of the advanced gas piston system. In this embodiment, the gas block 350B is configured in such a way to guide the piston 360B through the gas block 350B. The piston 360B has port holes which capture the expanding combustion gases and force the piston and attached rod forward.

In both embodiments, when a round is chambered, the main spring 320A or 330B decompresses, pushing the sending block rod 290A, rod connector 300A, piston rod 310A, piston 360A or 360B to the rearward. The sending Block 280 and sending block rack 270 moves rearward. The gear 260 rotates counterclockwise while the bolt body rack 240 moves forward. The attached bolt carrier 210 moves forward which pushes the next bullet into the barrel extension 440. The camming surface on top of bolt carrier 210 rotates the bolt 110 clockwise locking it into barrel extension 440 chamber.

Figure 3A:
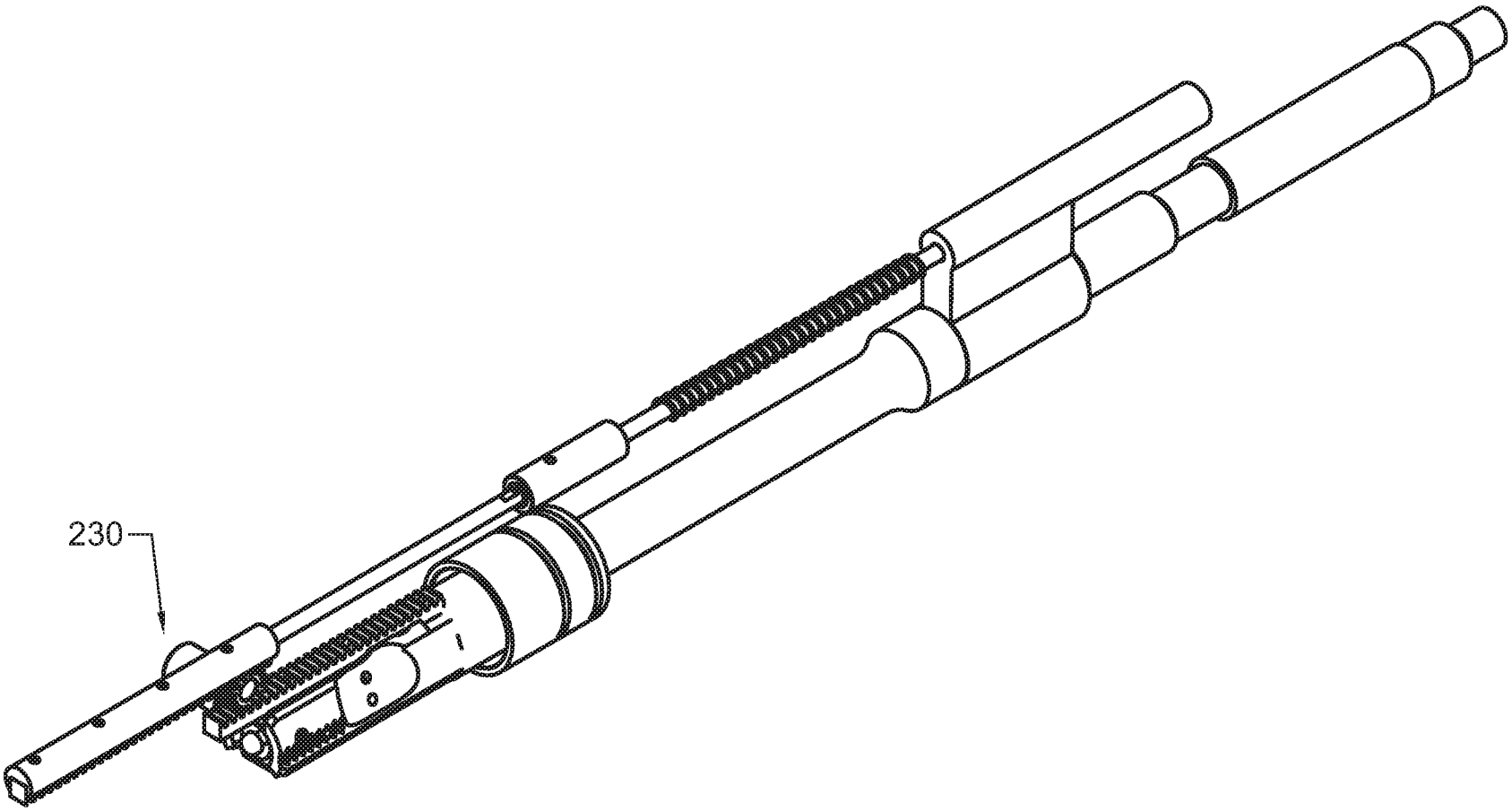
FIG. 3A is a perspective view of one variant of the advanced gas piston system in accordance with an embodiment of the invention.
Figure 3B:
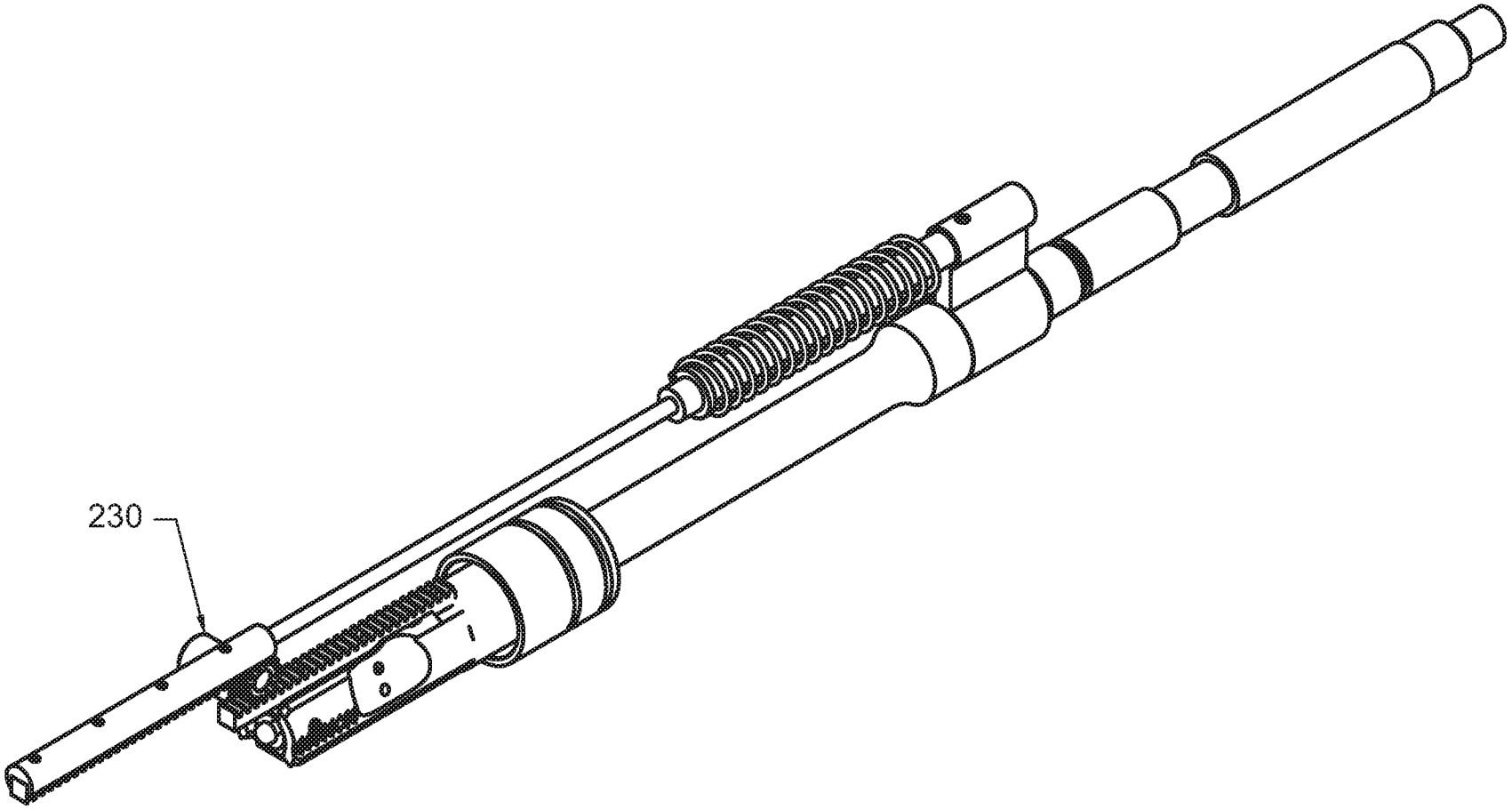
FIG. 3B is a perspective view of another variant of the advanced gas piston system in accordance with an embodiment of the invention.

FIG. 3A and 3B illustrate perspective views of the advanced gas piston system in accordance with two embodiments of the invention. In contrast to the T-shaped standard charging handle known in Armalite Rifle and Armalite Rifle variants, the advanced gas piston system employs the use of a bolt handle 230 which is attached to the bolt carrier 210 for chambering rounds into the rifle's barrel. The bolt handle 230 may be attached to the bolt carrier 210 by various means such as, but not limited to, a screw mechanism.

Figure 4:
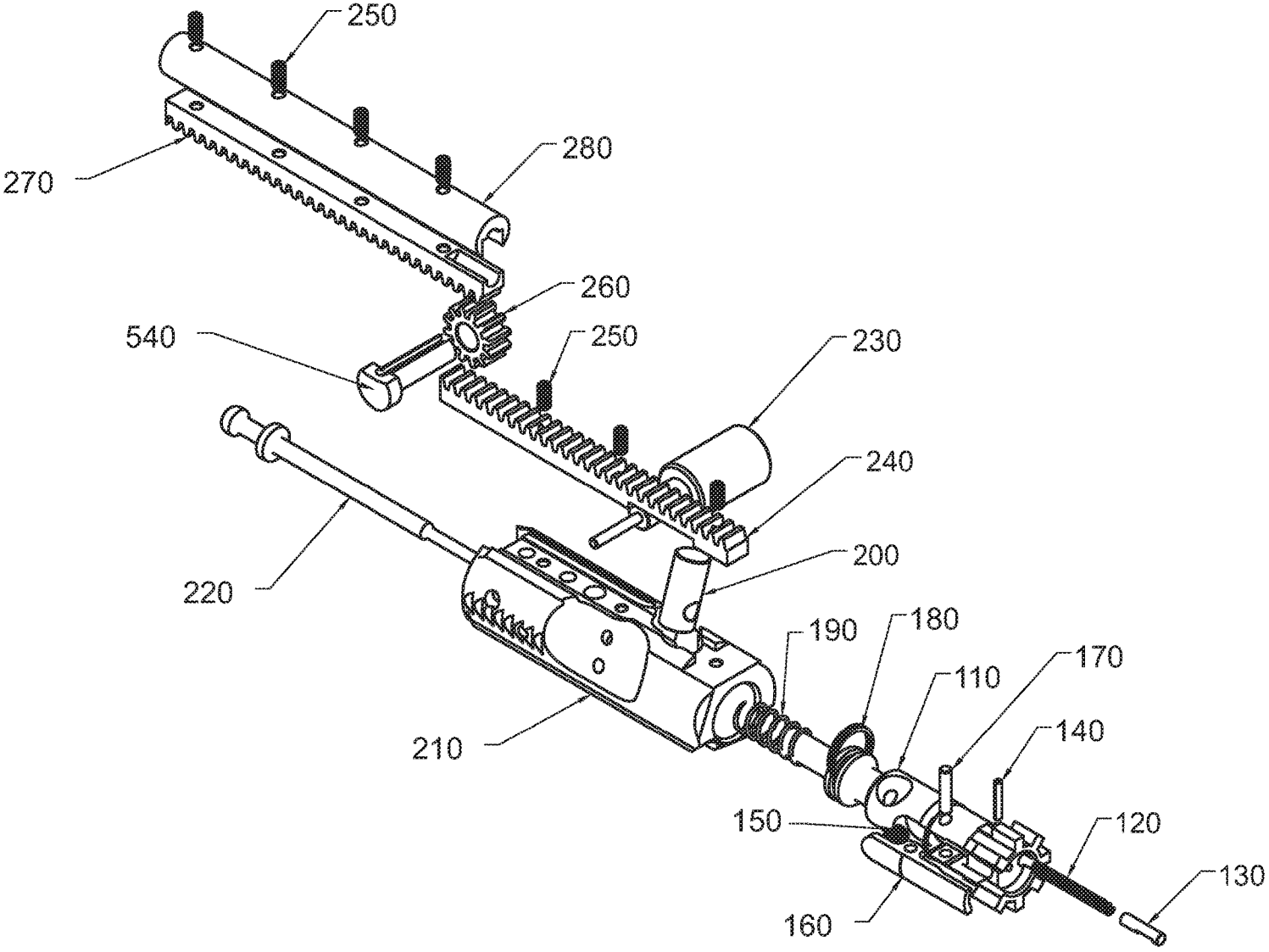
FIG. 4 is an exploded perspective view of the bolt carrier assembly of the advanced gas piston system in accordance with an embodiment of the invention.

FIG. 4 illustrates an exploded perspective view of the bolt carrier assembly of the advanced gas piston system in accordance with an embodiment of the invention. The bolt 110 is a standard AR type which has an extractor 160 connected by an extractor pin 170. The extractor 160 uses an extractor spring 150 to grasp onto a groove on the back of a bullet casing. The bolt also has an ejector 130 which is spring loaded with an ejector spring 120 and held in place by an ejector roll pin 140 to extract the bullet casing when the bolt moves rearward into the bolt carrier 210 which has a camming surface. The bolt uses gas rings 180 to provide a seal. The bolt cam pin 200 is held in place by the firing pin 220 and locks the bolt 110 into the bolt body 210. The camming surface on top of the bolt body 210 allows the bolt to rotate clockwise and counter clockwise from within the barrel extension 440. The camming surface on the bolt 110 locks and unlocks the bolt 110 from within the barrel of a rifle upon moving forward or rearward. A bolt cam pin 200 extends from the bolt 110 carried by bolt carrier 210.

The bolt carrier 210 can either be round or square with or without supporting rails that guide the bolt carrier group's travel along the inside of the AR's upper receiver. The bolt carrier 210 also houses the firing pin 220. The bolt carrier has a bolt carrier rack 240 that can be attached either by screws or pins 250. In alternative embodiments, the bolt carrier rack 240 can be welded to the bolt carrier 210, or machined as a single part onto the bolt carrier 210. The bolt carrier rack is designed to accept the teeth of a gear 260 to move the bolt carrier rack 240, bolt carrier 210 and bolt 110. The gear 260 is held in place by a pin 540 directed through the upper receiver. The sending block rack 270 is attached to the sending block 280 either by screws or pins 250. However, in other embodiments, the sending block rack 270 can be attached by welds or could be machined as a single piece into the sending block 280. The sending block rack 270 is designed to accept the teeth of the gear 260 to allow the movement of the sending block rack 270 and sending block 280. The sending block 280 can be either round or square.

As is well known in the art, the bolt carrier 210 on a standard Armalite Rifle or Armalite Rifle variant has a firing pin retainer pin that holds the firing pin in place. The firing pin retainer pin hole on the bolt carrier 210 can be machined and threaded to accept the threads of the bolt handle 230, which can be attached. The bolt handle 230 is machined on one end with the diameter of the firing pin retainer to hold the firing pin in place. The bolt handle 230 serves two functions: First, the bolt handle is used to move the bolt carrier to the rearward and forward position, and secondly it functions as the firing pin retainer pin.

Figure 5A:
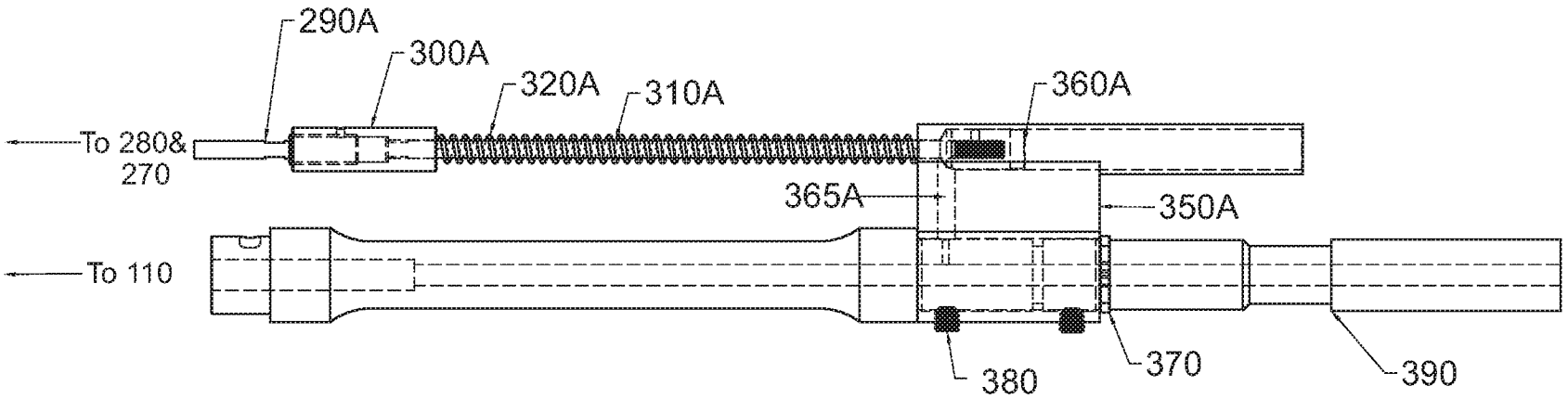
FIG. 5A is a side cross-sectional view of the gas piston assembly of one variant of the advanced gas piston system in accordance with an embodiment of the invention.

FIG. 5A illustrates a side cross-sectional view of the gas piston assembly of one embodiment of the advanced gas piston system. In this view, the gas block 350A is attached to the barrel 390 by a gas block retainer clip 370 and gas block set screws 380. Expanding gases are routed through the gas port 365A which drives the piston forward. The main spring 320A can be, but is not limited to, a coiled spring, a braided coil spring or a flat coiled spring made of varying materials such as, but not limited to, brass or steel. In this embodiment, a chamber extending from the gas block 350A houses the piston 360A. The chamber is located within the gas block 350A, and is configured to create greater pressure to move the piston 360A and the piston rod 310A forward when the rifle is fired. When the rifle is fired, gas travels through the gas port 365A which drives the piston forward into the chamber. This action compresses the main spring 320A while pulling the sending block rod 290A which is connected to the piston rod 310A by a rod connector 300A. In such an embodiment, the piston 360A may be threaded into, welded or attached to the sending block in any such manner which operates the sending block.

Figure 5B:
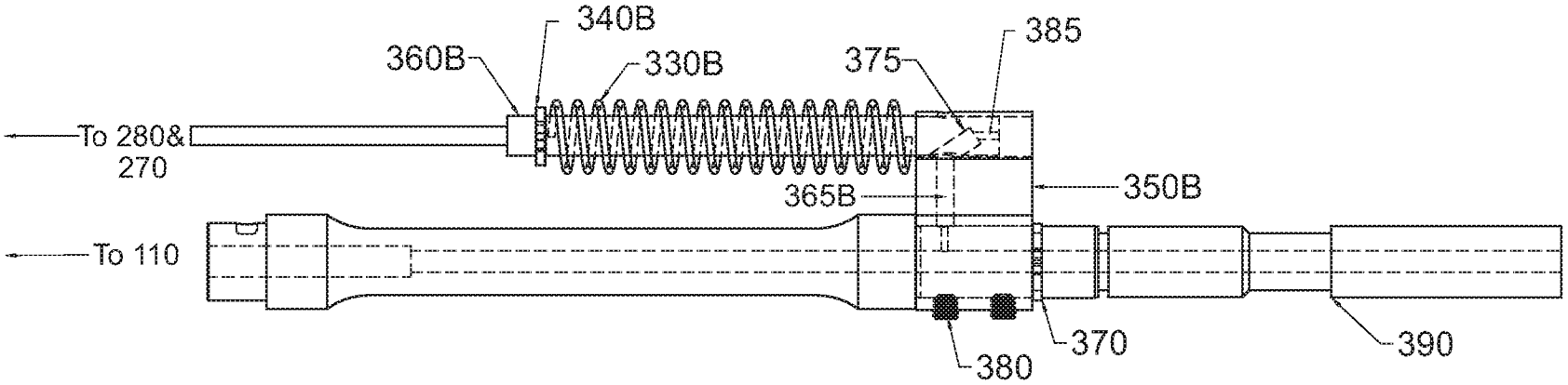
FIG. 5B is a side cross-sectional view of the gas piston assembly of another variant of the advanced gas piston system in accordance with an embodiment of the invention.

FIG. 5B illustrates a side cross-sectional view of the gas piston assembly of one embodiment of the advanced gas piston system. In this view, the gas block 350B is attached to the barrel 390 by a gas block retainer clip 370 and gas block set screws 380. Expanding gases are routed through the gas port 365A which drives the piston forward. The main spring 320A can be a coiled spring, braided coil spring or flat coiled spring made of varying materials such as, but not limited to, brass or steel. In this embodiment, no chamber extends from the gas block 350B. Here, the gas block 350B simply serves as a guide for the piston 360B which has port holes 375 which force the piston 360B and attached rod forward. When the rifle is fired, gas travels through the gas port 365B which drives the piston forward through the gas block 350B. This action compresses the main spring 330A which is held in place with a main spring retainer clip 340A. In such an embodiment, the piston 360B may be ported as to accept the gas from the gas port 365B. Furthermore, a secondary port 385 may extend through the front of the piston which allows gas to escape. The piston may be manufactured with a gas adjustment knob, which may adjust the gas pressure on the piston to help the firearm cycle properly with the use of different types of ammunition.

Figure 6A:
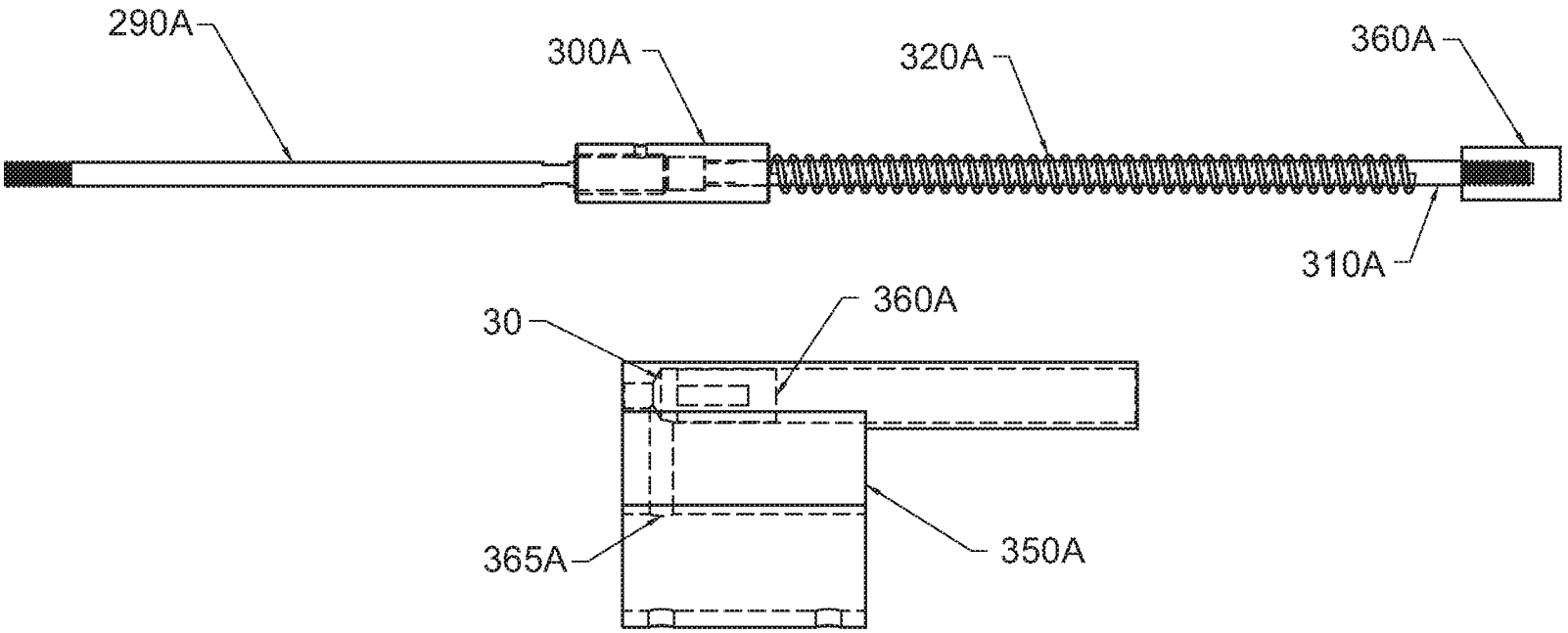
FIG. 6A is a side cross sectional view of the gas piston and gas block assemblies of one variant of the advanced gas piston system in accordance with an embodiment of the invention.

FIG. 6A illustrates a side cross sectional view of the gas piston and gas block assemblies of one variant of the advanced gas piston system. In this embodiment, the distal end of the piston rod 310 is threaded and screws into the piston 360A, which holds the main spring 320A in place. The rod connector 300A may be drilled or machined to accommodate the size of the piston rod 310A. The proximal end of the piston rod 310A has a slightly larger diameter on one end which allows it to seat inside the rod connector 300A. The sending block rod connector 290A may be threaded to fit inside of threads of the inner diameter of the rod connector 330A. The rod connector 300A, sending block rod 290A and piston rod 310 attach the sending block 280 and piston 360A. The rod connector 300A allows for the disassembly and reassembly of the piston system. The piston rod 320A and sending block rod 290A may be welded, machined threaded, or key slotted in a manner to connect the sending block 280 and piston 360A to function and for ease of assembly and disassembly of the system. When the rifle is fired, gas travels through the gas port 365A which drives the piston forward through the gas block 350A. This action compresses the main spring 330A which is held in place with a main spring retainer clip 340A.

Figure 6B:
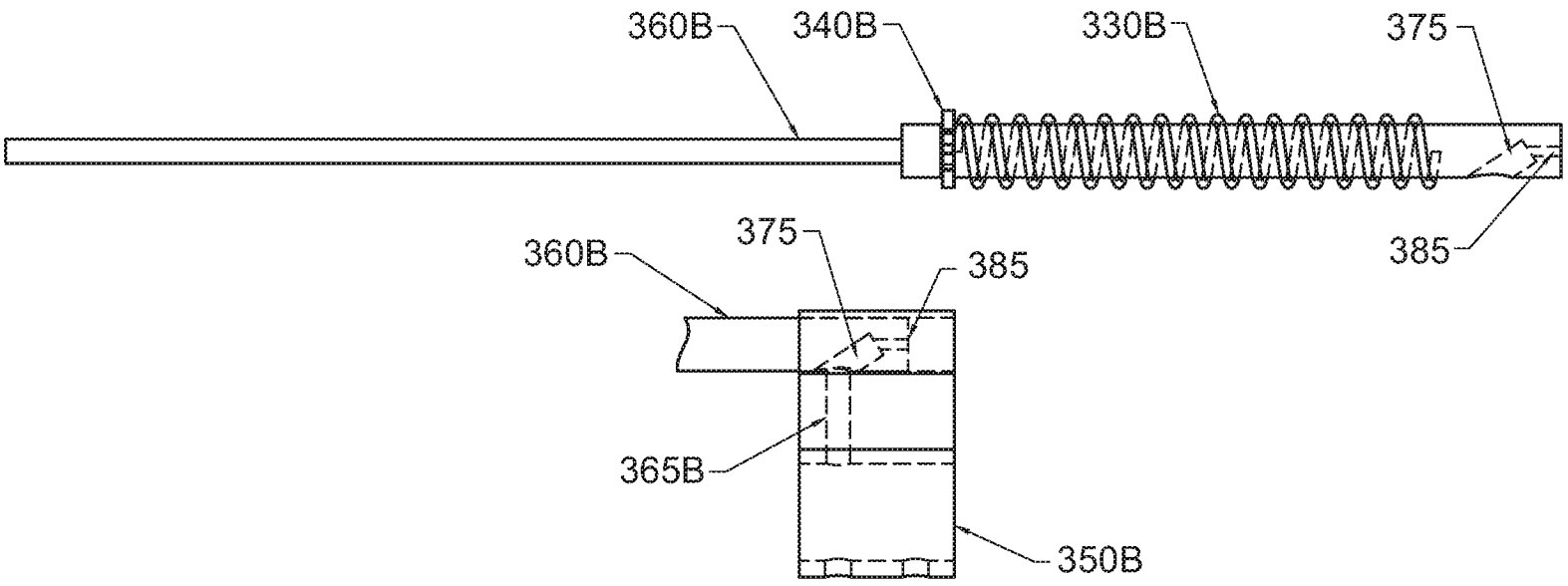
FIG. 6B is a side cross sectional view of the gas piston and gas block assemblies of another variant of the advanced gas piston system in accordance with an embodiment of the invention.

FIG. 6B illustrates a side cross sectional view of the gas piston and gas block assemblies of an alternative variant of the advanced gas piston system. In such an embodiment, the piston 360B may be ported 375 as to accept the gas from the gas port 365B. The main spring 320A can be a coiled spring, braided coil spring or flat coiled spring made of varying materials such as, but not limited to, brass or steel. In this embodiment, no chamber extends from the gas block 350B. Here, the gas block 350B simply serves as a guide for the piston 360B which has port holes 375 which force the piston 360B and attached rod forward. When the rifle is fired, gas travels through the gas port 365B which drives the piston forward through the gas block 350B. This action compresses the main spring 330B which is held in place with a main spring retainer clip 340B. In such an embodiment, the piston 360B may be ported as to accept the gas from the gas port 365B. Furthermore, a secondary port 385 may extend through the front of the piston which allows gas to escape.

Figure 7B:
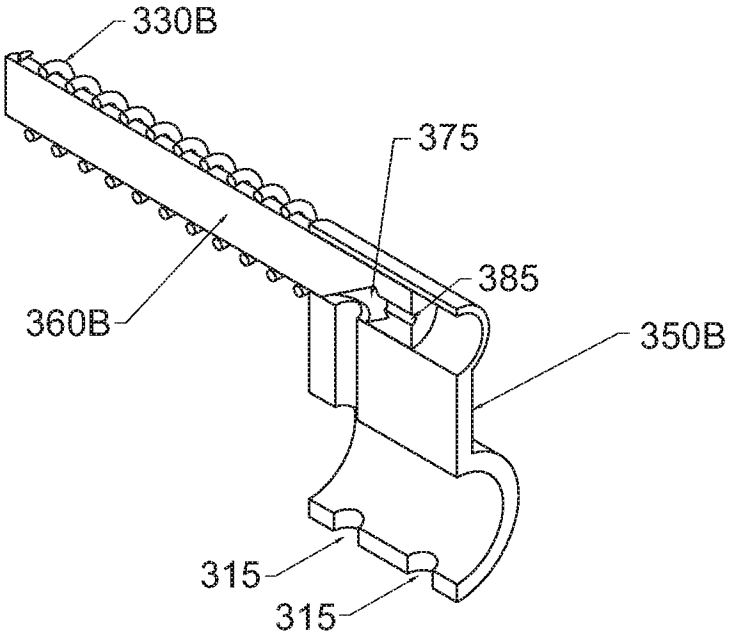
FIG. 7B is a perspective cross-sectional view of the gas block and gas piston in accordance with an embodiment of the invention.
Figure 7A:
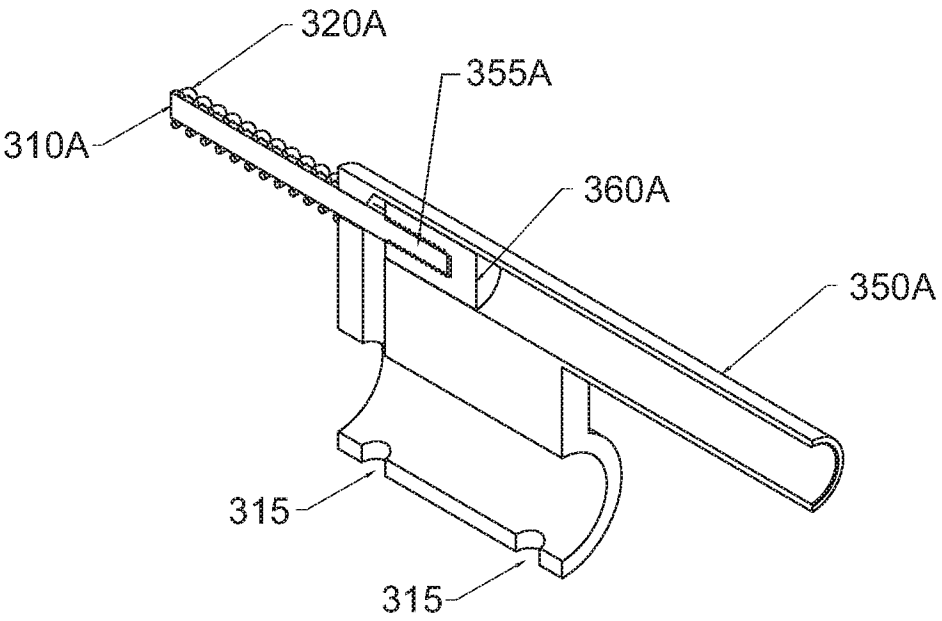
FIG. 7A is a perspective cross-sectional view of the gas block and gas piston in accordance with an embodiment of the invention.

FIG. 7A illustrates a cross sectional view of the gas block assembly of one embodiment of the advanced gas piston system. The gas block attaches to the barrel through the use of two gas block set screws which pass through two holes 315 in the gas block. In this embodiment, a chamber extending from the gas block 350A houses the piston 360A. The chamber is located within the gas block 350A, and is configured to create greater pressure to move the piston 360A and the piston rod 310A forward when the rifle is fired. This action compresses the main spring 320A while pulling the sending block rod which is connected to the piston rod 310A by a rod connector 300A. In such an embodiment, the piston 360A may be threaded and into 355A, welded or attached to the piston rod 310A. The gas block 350A and 350B can be machined, 3D printed or cast from a variety of materials such as aluminum, steel and upgraded carbon fibers and plastics.

FIG. 7B illustrates a cross sectional view of the gas port of an alternative embodiment of the advanced gas piston system. The gas block assembly attaches to the barrel through the use of two gas block set screws which pass through two holes 315 in the gas block. In this embodiment, no chamber extends from the gas block 350B. Here, the gas block 350B simply serves as a guide for the piston 360B which has port holes that force the piston 360B and attached rod forward. This action compresses the main spring 330A while . In such an embodiment, the piston 360B may be ported 375 as to accept the gas from the gas port 365A or 365B. Furthermore, a secondary port 385 may extend through the front of the piston which allows gas to escape. The gas block 350B can be machined, 3D printed or cast from a variety of materials such as aluminum, steel and upgraded carbon fibers and plastics.

Figure 8A:
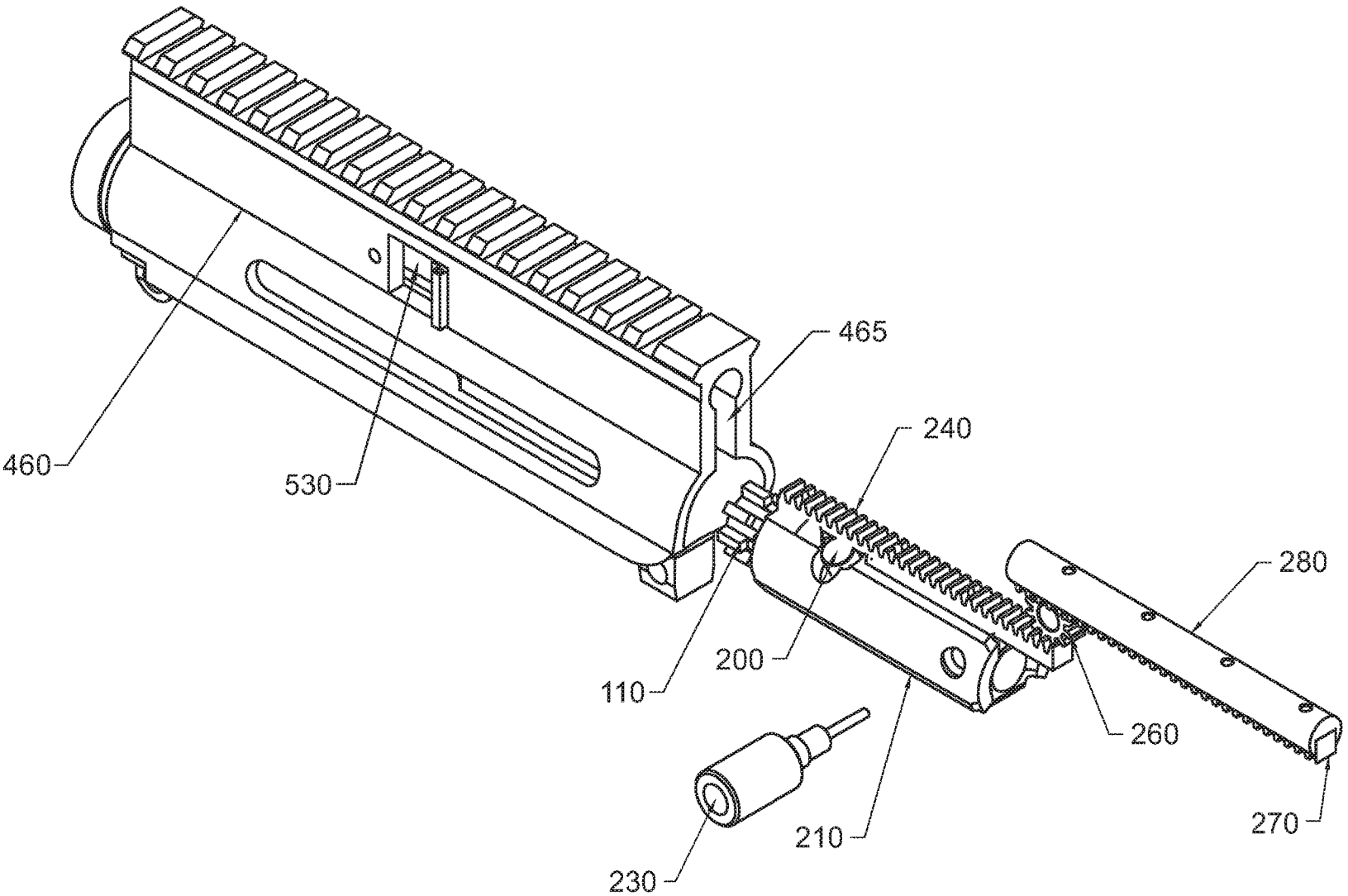
FIG. 8A is an exploded perspective view of the bolt carrier group and upper receiver assembly of the advanced gas piston system in accordance with an embodiment of the invention.

FIG. 8A illustrates an exploded view of the upper receiver and bolt carrier group assembly of the advanced gas piston system. The advanced gas piston system is essentially a novel system that attaches to existing AR lower receiver platforms. The sending block 280 and its components are guided by a cut out 465 in the upper portion of the upper receiver 460, and requires slightly more room than standard AR upper receivers. As such, a modified upper receiver 460 may be stamped, milled or otherwise fabricated in a manner so as to accept the components of the advanced gas piston system. Among these special modifications are accommodations for the gear hatch 530. The upper receiver also requires a slot for the charging handle to be machined on the left side of the receiver. The charging handle 230 can be attached to the bolt or manufactured so as not to move when the system is firing. The lower portion of the AR upper receiver specifically where the bolt body group is housed; may be machined in the same manner as current AR platforms. The cut out for the hammer and magazine are the same as existing AR upper receivers. The threads for the barrel are the same for the Standard AR platform. Furthermore, the lugs which lock into an Armalite rifle lower receiver are the same.

Figure 8B:
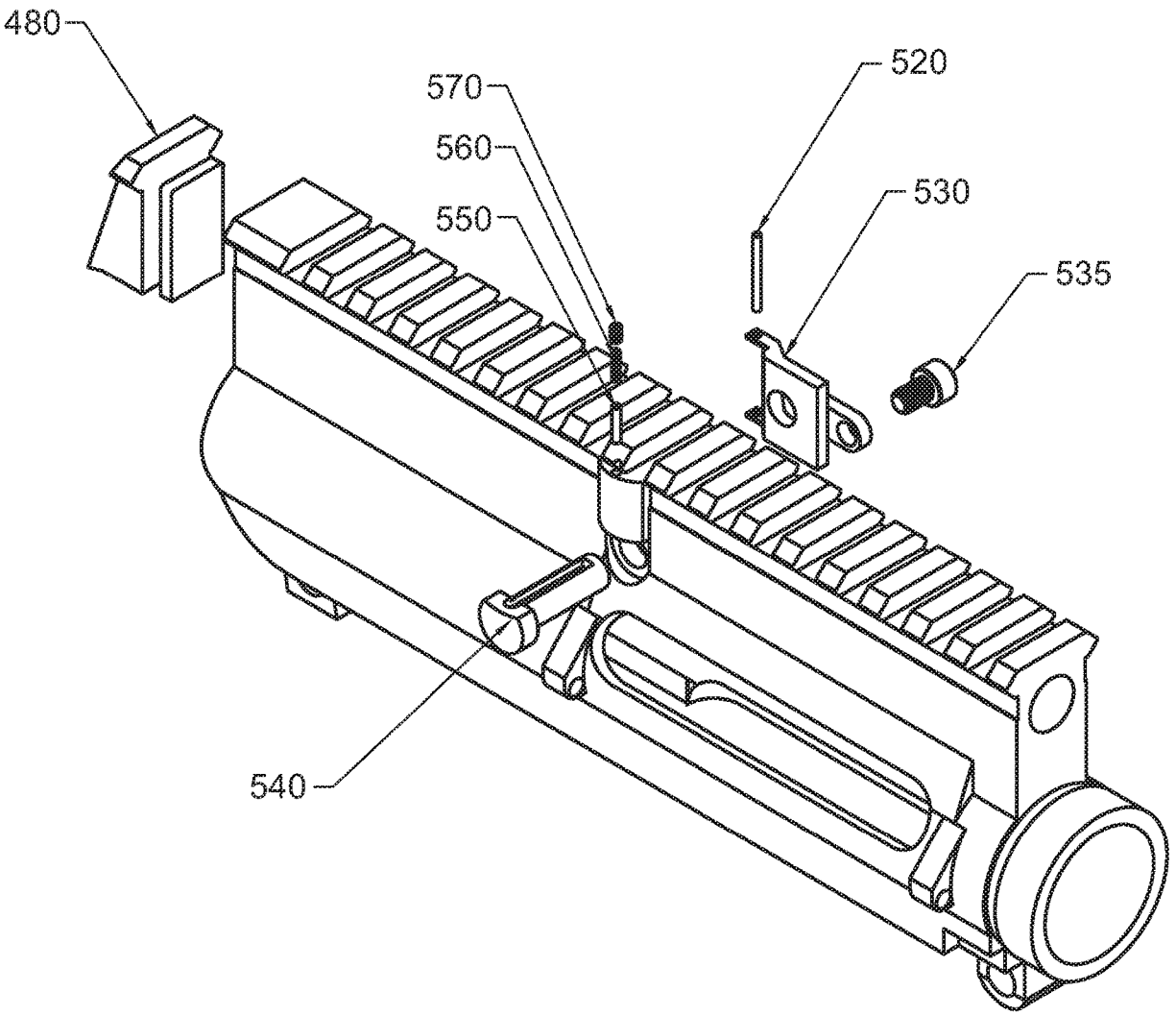
FIG. 8B is an exploded perspective view of the upper receiver assembly and bolt carrier group components in accordance with an embodiment of the invention.

FIG. 8B illustrates an exploded alternative view of the upper receiver assembly of the advanced gas piston system. The gear 260 which engages the sending block 280 and the bolt carrier 210 is held in place by gear pin 540 which slides through the upper receiver body 460, the gear 260 and out the opposite end of the upper receiver body. The gear pin 530 is held in place through the use of a gear pin plunger 550, gear pin spring 560 and a gear pin set screw 570. On the opposite side of the upper receiver body 460, the gear hatch 530 is held in place by a gear hatch pin 520 and a gear pin bolt 535. The bolt carrier group is ultimately protected by a back plate 480 which is fastened to the rear of the upper receiver 460.

Figure 8C:
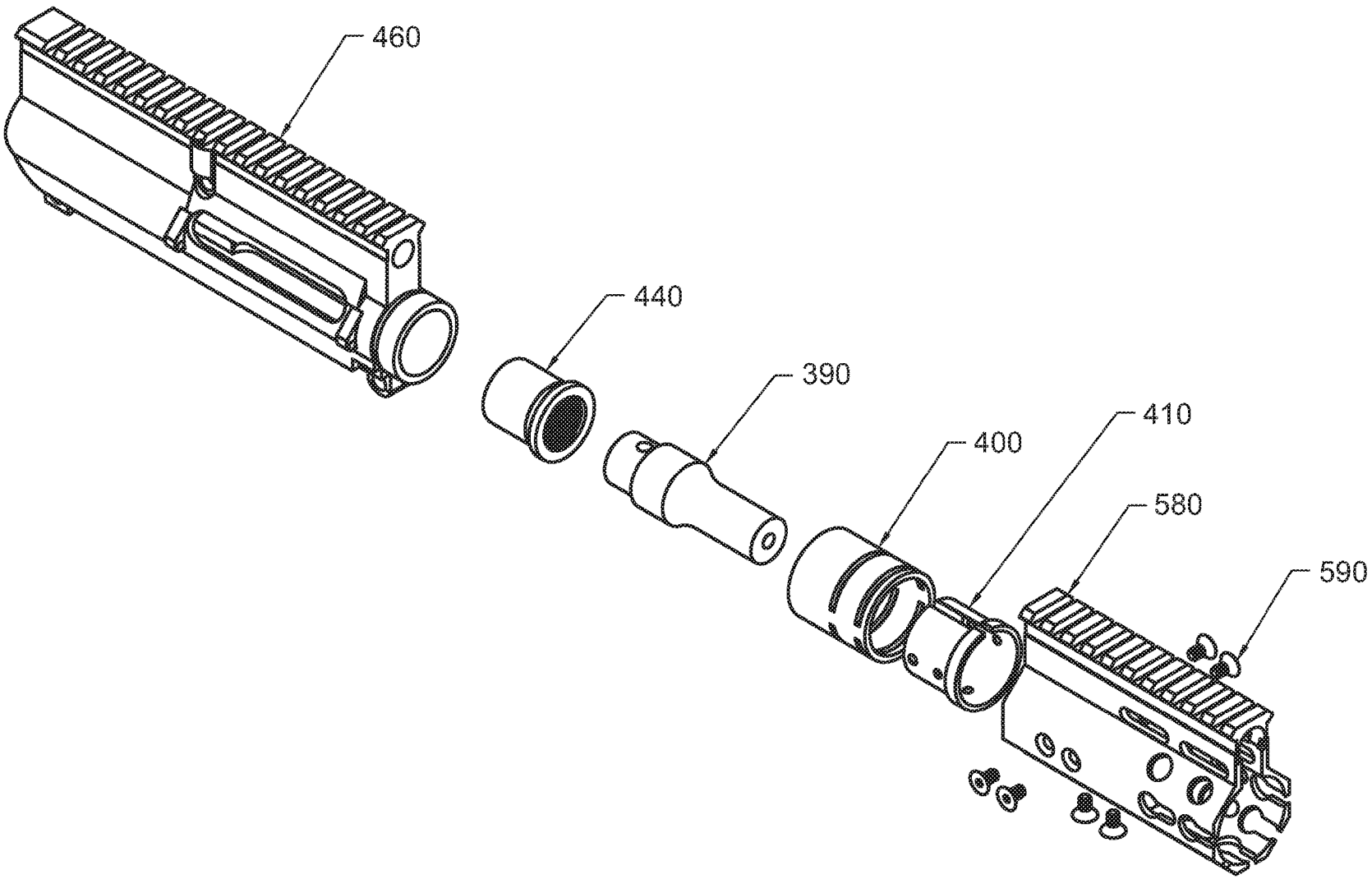
FIG. 8C is an exploded perspective view of the upper receiver assembly and barrel connection assemblies in accordance with an embodiment of the invention.

FIG. 8C illustrates an exploded perspective view of the upper receiver assembly and barrel connector assembly of the advanced gas piston system. The barrel extension 440 is threadedly connected to the barrel 390. The barrel nut 400 is threadedly connected to the upper receiver 460 which locks the barrel extension 440 and barrel 390 into position. The mod rail adapter 410 slides into barrel nut 400 and accepts the key mod rail 580. The key mod rail is held into place with set screws 590 that thread into the key mod rail adapter 400.

Figure 9A:
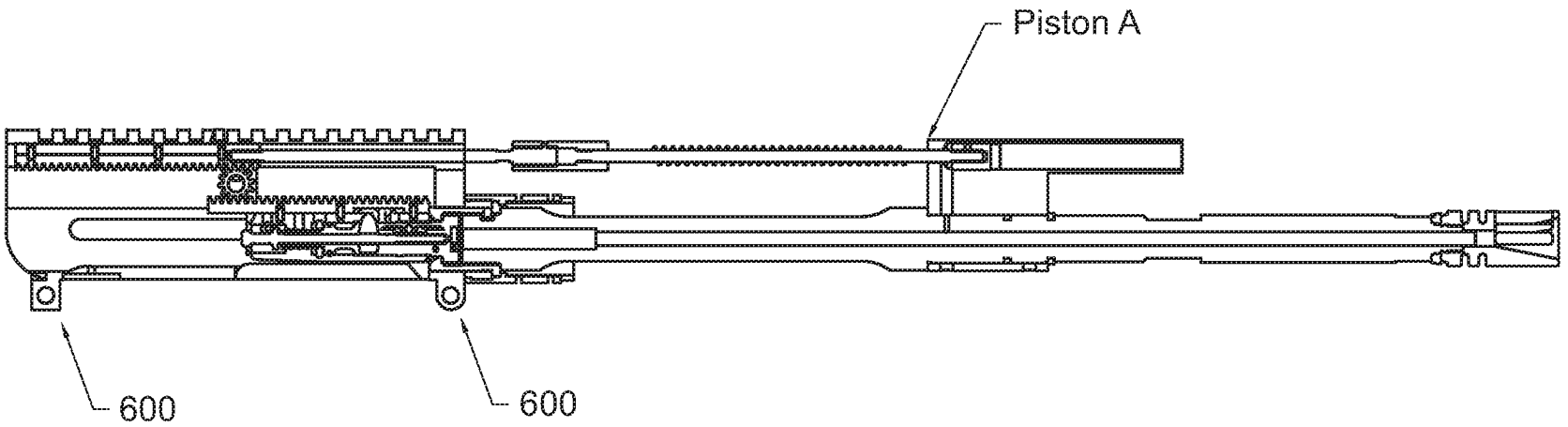
FIG. 9A is a side cross-sectional view of the upper receiver, barrel and bolt carrier assembly of the advanced gas piston system in accordance with an embodiment of the invention.
Figure 9B:
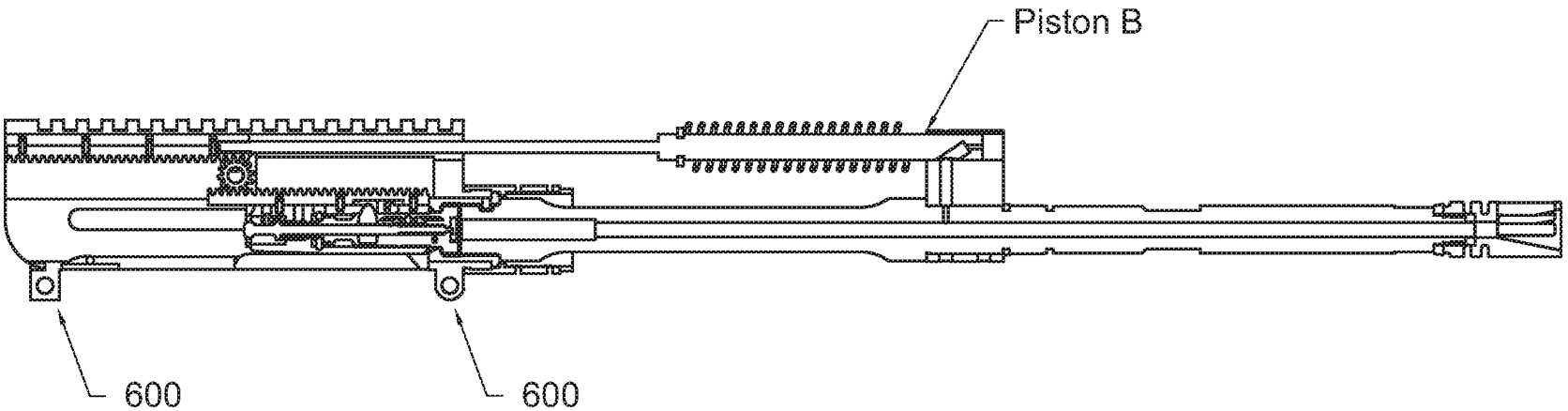
FIG. 9B is a side cross-sectional view of the upper receiver, barrel, and bolt carrier assembly of the advanced gas piston system in accordance with an embodiment of the invention.

FIG. 9A and FIG. 9B illustrate side cross-sectional views of the upper receiver and barrel assemblies of the advanced gas piston system in accordance with two embodiments of the invention. Persons skilled in the art will recognize that the advanced gas piston system is an upper receiver assembly which locks into the standard Armalite Rifle and Armalite Rifle variant platform lower receiver assembly. Furthermore, as is known and practiced in the art, the upper receiver of the advanced gas piston system will have two lugs 600 with holes which lock into lugs on the standard Armalite Rifle lower receiver assembly. The pins on the standard Armalite Rifle lower receiver lock into the holes on the lugs 600 of the advanced gas piston system in the same manner that current Armalite Rifle upper receivers lock into standard Armalite Rifle lower receivers.

Figure 10:
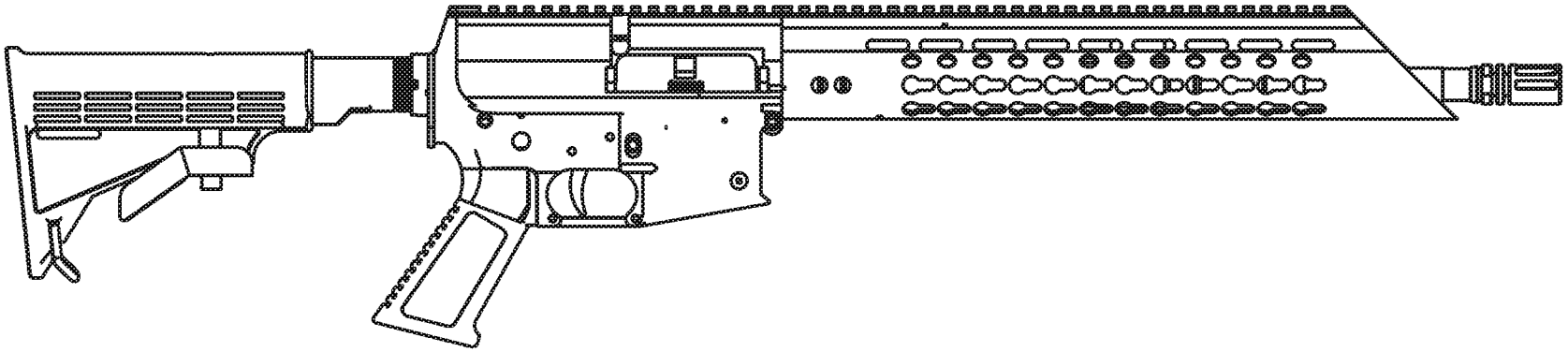
FIG. 10 is a side view of a fully assembled rifle employing the advanced gas piston system in accordance with an embodiment of the invention.

FIG. 10 illustrates a side view of a fully assembled rifle employing the advanced gas piston system in accordance with an embodiment of the invention. The advanced gas piston system is designed to attach to most standard AR lower receiver platforms. It is well known in the art that a fully assembled rifle comprises a lower receiver wherein the lower receiver is coupled to a pistol grip, a collapsible stock, a trigger housing, a magazine holder, and all other components that are conventionally part of a lower receiver assembly associated with the Armalite Rifle or Armalite Rifle variants. The assembled rifle further comprises a shroud which covers the barrel, the upper receiver which contains the bolt carrier assembly, and the barrel assembly as well.

Figure 11A:
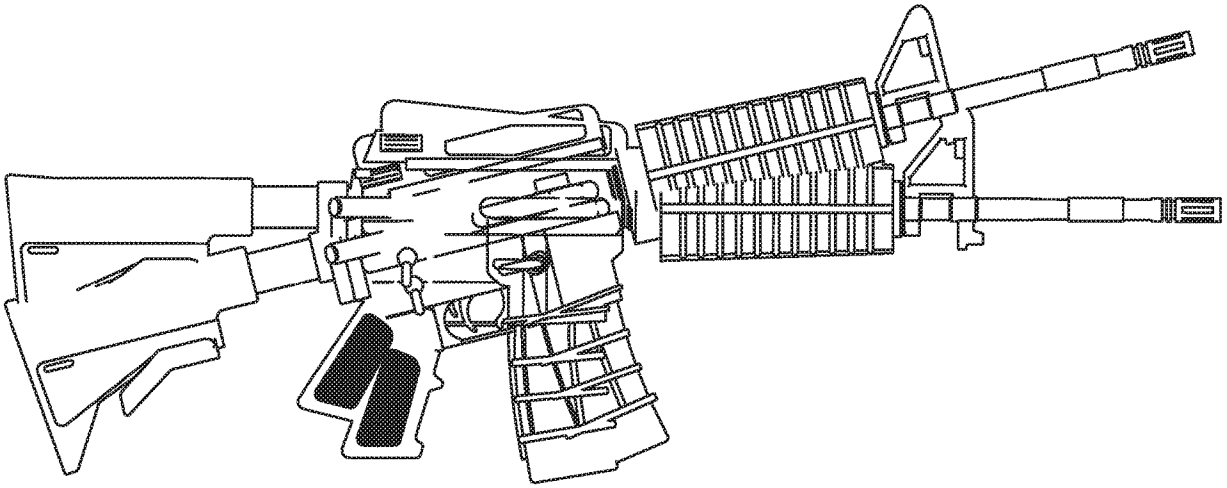
FIG. 11A (Prior Art)
FIG. 11A is a side view representation of the muzzle rise typically encountered with the use of a prior art rifle employing a prior art gas impingement system or prior art piston system.

FIG. 11A is a side view representation of the muzzle rise typically encountered with the use of a prior art rifle employing a prior art gas impingement system or prior art piston system. Muzzle rise is the front end of a firearm barrel rising upward as each round is fired. When a bullet is fired in a typical prior art system, the bullet motion and the escaping propellant gases exert a reactional recoil directly backwards along the axis of the barrel while the countering forward push from the shooter's hands and body are well below it. This creates a rotational torque around the center of mass, which causes the muzzle end to rise upwards. Muzzle rise is increased when multiple shots are fired.

Figure 11B:
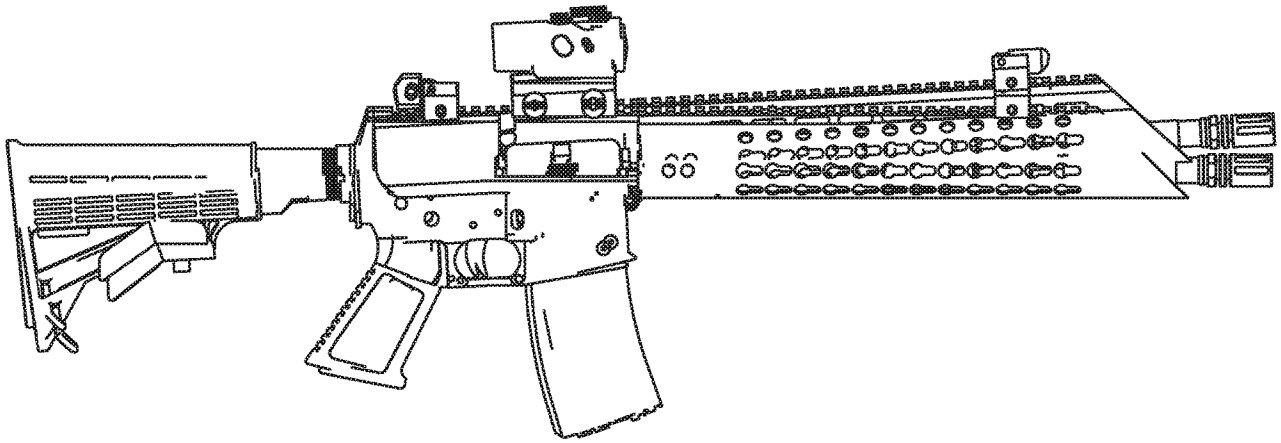
FIG. 11B is a side view representation of the muzzle rise encountered with the use of the advanced gas piston system.

FIG. 11B is a side view representation of the muzzle rise encountered with the use of the advanced gas piston system. The present invention counters muzzle rise by reducing or eliminating rearward recoil forces and by increasing the moment of inertia by attaching additional weight to the muzzle end of the barrel, thereby countering the torque force created by recoil. This allows the shooter to maintain the same sight picture without having to realign the sights after each trigger pull especially when multiple shots are fired.

Figure 12A:
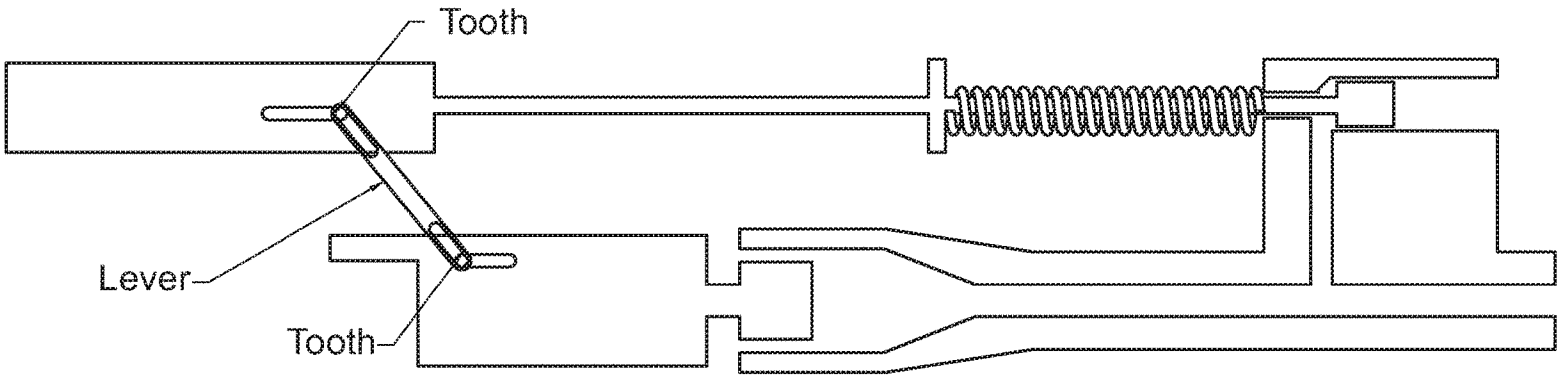
FIG. 12A is a side sectional functional representation of an alternative embodiment of the carrier block and bolt carrier group of the advanced gas piston system in accordance with an embodiment of the invention.
Figure 12B:
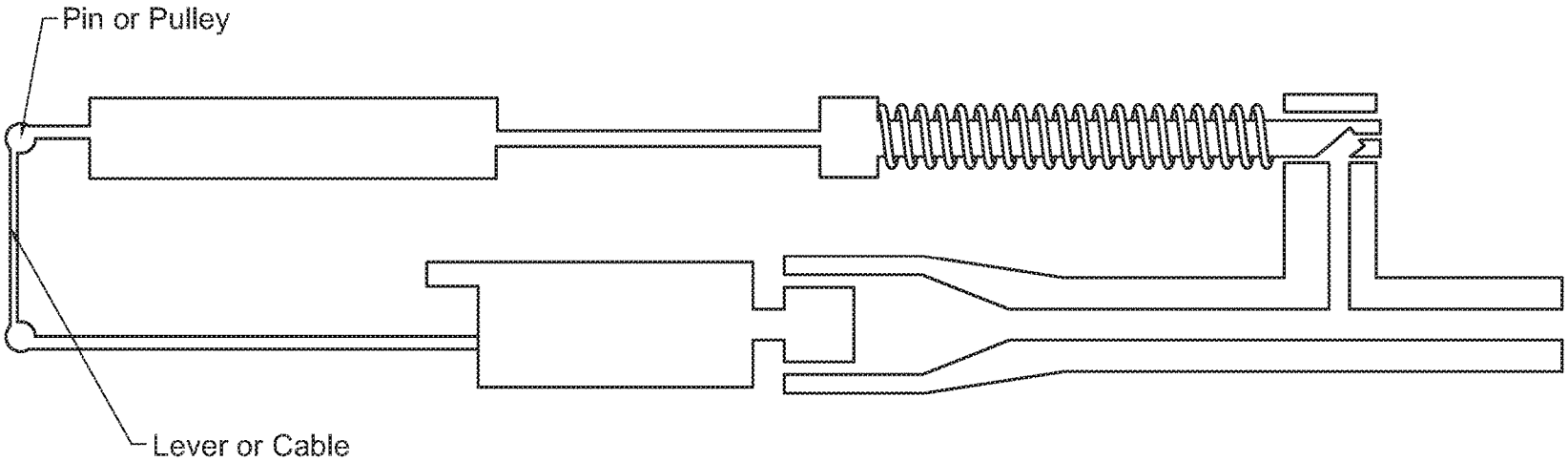
FIG. 12B is a side sectional functional representation of an alternative embodiment of the carrier block and bolt carrier group of the advanced gas piston system in accordance with an embodiment of the invention.
Figure 12C:
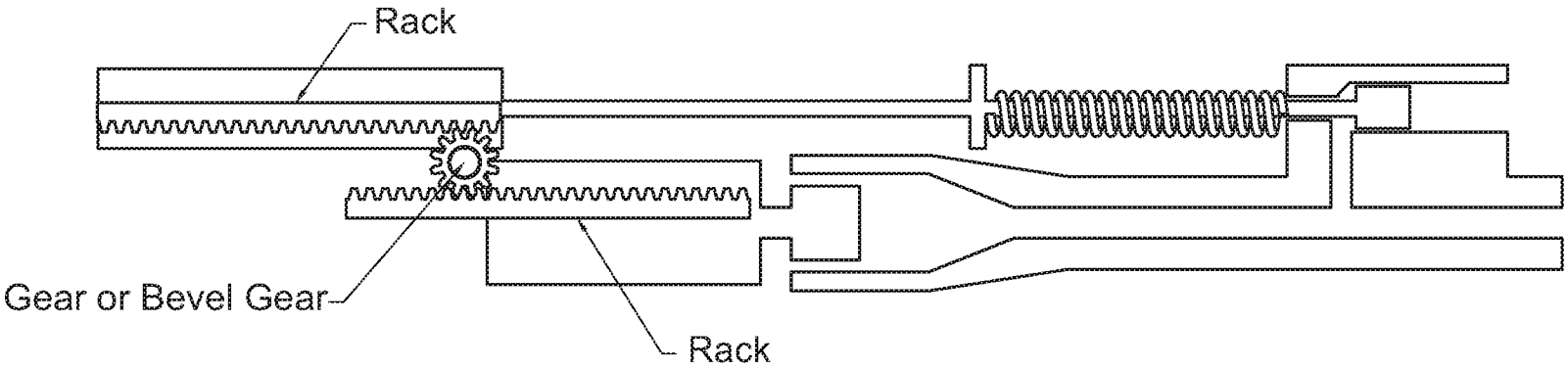
FIG. 12C is a side sectional functional representation of an alternative embodiment of the carrier block and bolt carrier group of the advanced gas piston system in accordance with an embodiment of the invention.

FIG. 12A, FIG. 12B, and FIG. 12C illustrate functional side cross sectional views of three alternative embodiments of the advanced gas piston system contemplated as within the scope of the present invention. FIG. 12A illustrates an embodiment that employs a side lever which can operate the movement of the bolt carrier group and sending block assembly. When the sending block moves forward, a side lever engages a tooth on the side of the bolt carrier group forcing it to the rear, compressing the main spring. When the main spring decompresses, the side lever engages the tooth on the sending block, moving it rearward. As a result, the lever engages the tooth on the bolt carrier group moving it forward. FIG. 12B illustrates an alternative means to move the sending block and bolt carrier group. In this embodiment, levers or a wire cable are attached to the rear of the bolt carrier group and the sending block. The levers or cable wire rotate on pins or pulleys to allow the horizontal movement of the bolt carrier group and the sending block. When the sending block moves forward the levers or cable wire are attached to the rear of the sending block and bolt carrier group counter act each other's movement. Thus, when the bolt carrier group moves forward the sending block moves rearward, and when the sending block moves rearward the bolt carrier group moves forward. FIG. 12C illustrates an alternative embodiment that employs a gear or bevel gear which can operate the movement of the bolt carrier group and sending block assembly. The bolt carrier group and sending block assembly have a rack that is attached to their sides. When the sending block moves forward the attached rack engages the teeth on the gear or bevel gear rotating it clockwise. The gear teeth engage the rack teeth attached to the bolt carrier group forcing it to the rear, compressing the main spring. When the main spring decompresses the sending block and attached rack move to the rear, engaging the teeth on the gear or bevel gear. The gear rotates counterclockwise engaging the teeth on the rack attached to the bolt carrier group moving it forward.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the advanced gas piston system, other equivalent or alternative methods of implementing the advanced gas piston system according to the present invention will be apparent to those skilled in the art. Various aspects of the invention have been described above by way of illustration, and the specific embodiments disclosed are not intended to limit the invention to the particular forms disclosed. The particular implementation of the advanced gas piston system may vary depending upon the particular context or application. By way of example, and not limitation, the advanced gas piston system described in the foregoing was principally directed to Armalite Rifle (AR) variations. However, similar techniques may instead be applied to other gas-operated autoloading rifles which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of the advanced gas piston system are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively, and are not limited to any physical interconnection. Claim elements and steps herein may have been numbered and/or lettered solely as an aid in readability and understanding. Any such numbering and lettering in itself is not intended to and should not be taken to indicate the ordering of elements and/or steps in the claims to be added at a later date.

Any amendment presented during the prosecution of the application for this patent is not a disclaimer of any claim element presented in the description or claims to be filed. Persons skilled in the art cannot reasonably be expected to draft a claim that would literally encompass each and every equivalent.

What is claimed is:

1. A method for operating a reversed impingement system for AR rifles or AR style firearms having a barrel including a gas port; a gas block assembly wherein the said gas block assembly connects to the said barrel and has a gas port which communicates with the said gas port of the said barrel and creates a gas passage wherein a piston is driven forward by combustion gases; a gas piston assembly consisting of a piston, a piston rod, a main spring, and a rod connector, said gas piston assembly configured to connect to and drive a bolt carrier assembly; an upper receiver assembly; a lower receiver assembly; a magazine; and a bolt carrier assembly including a sending block and rack and pinion gear system which connect to the said gas piston assembly, said method comprising the steps of:

a. firing a chambered round;

b. directing a portion of the combustion gases from a fired projectile from the barrel including a gas port through the said gas port into a gas block assembly wherein the said gas block assembly connects to the said barrel;

c. using said portion of the said directed combustion gases in the gas block to drive a piston, attached piston rod and sending block with attached rack with teeth forward in the direction of the said fired projectile;

d. using the energy of the forward moving piston and attached piston rod to compress a main spring which surrounds the said piston rod;

e. using the forward moving sending block with attached rack with teeth to engage a gear which is rotatably engaged with the teeth of a rack that is attached to the bolt carrier assembly;

f. moving the bolt body group rearward while the sending block, piston rod, and piston move forward until the main spring is fully compressed; and g. decompressing the main spring to return the piston, piston rod, sending block with attached rack to the rear which engages the gear which engages with a the said attached rack of the bolt body group which rotates and moves the said bolt body group forward in the direction of the said fired projectile.

2. The method of claim 1 wherein the bolt carrier assembly including a sending block and rack and pinion gear system which connect to the said gas piston assembly is a modified bolt carrier used in an AR rifle or AR style firearm.

3. The method of claim 1 wherein the lower receiver assembly is the lower receiver assembly of an AR rifle or AR style firearm.

4. The method of claim 1 wherein the upper receiver assembly is modified in a manner so as to accept the components of the advanced gas piston system.

5. The method of claim 1 wherein the motion of the bolt carrier assembly is used to eject a spent cartridge from the rifle.

6. The method of claim 1 wherein the motion of the bolt carrier assembly is used to reload a new cartridge into the barrel.

7. A method for operating an advanced gas piston system for AR rifles or AR style firearms, which eliminates the need for a buffer and buffer spring system, having a barrel having a gas port; a gas block assembly wherein the said gas block assembly connects to the said barrel and has a gas port which communicates with the said gas port of the said barrel and creates a gas passage wherein a piston is driven forward by combustion gases; a gas piston assembly consisting of a piston, a piston rod, a main spring, and a rod connector, said gas piston assembly configured to connect to and drive a bolt carrier assembly; an upper receiver assembly; a lower receiver assembly; a magazine; and a bolt carrier assembly including a sending block and rack and pinion gear system which connect to the said gas piston assembly said method comprising the steps of:

a. firing a chambered round;

b. directing a portion of the combustion gases from a fired projectile from the barrel having gas port through the said gas port into a gas block assembly wherein the said gas block assembly connects to the said barrel;

c. using said portion of the said directed combustion gases in the gas block to drive a piston, attached piston rod and sending block with attached rack with teeth forward in the direction of the said fired projectile;

d. using the energy of the forward moving piston and attached piston rod to compress a main spring which surrounds the said piston rod;

e. using the forward moving sending block with attached rack with teeth to engage a gear which is rotatably engaged with the teeth of a rack that is attached to the bolt carrier assembly;

f. moving the bolt body group rearward while the sending block, piston rod, and piston move forward until the main spring is fully compressed; and g. decompressing the main spring to return the piston, piston rod, sending block with attached rack to the rear which engages the gear which engages with a the said attached rack of the bolt body group which rotates and moves the said bolt body group forward in the direction of the said fired projectile and moving the next cartridge from an attached magazine into the chamber.

h. moving the next cartridge from the magazine into the chamber.

8. The method of claim 7 wherein the bolt carrier assembly including a sending block and rack and pinion gear system which connect to the said gas piston assembly is a modified bolt carrier used in an AR rifle or AR style firearm.

9. The method of claim 7 wherein the lower receiver assembly is the lower receiver assembly of an AR rifle or AR style firearm.

10. The method of claim 7 wherein the upper receiver assembly is modified in a manner so as to accept the components of the advanced gas piston system.

* * * * *